US010211009B2

(12) United States Patent
Yajima et al.

(10) Patent No.: US 10,211,009 B2
(45) Date of Patent: Feb. 19, 2019

(54) SWITCH-CONTAINING CABLE

(71) Applicant: FOSTER ELECTRIC CO., LTD., Tokyo (JP)

(72) Inventors: Koichi Yajima, Tokyo (JP); Morikazu Nakada, Tokyo (JP)

(73) Assignee: FOSTER ELECTRIC COMPANY LIMITED, Tokyo (JP)

( * ) Notice: Subject to any disclaimer, the term of this patent is extended or adjusted under 35 U.S.C. 154(b) by 0 days.

(21) Appl. No.: 15/292,316

(22) Filed: Oct. 13, 2016

(65) Prior Publication Data

US 2017/0178839 A1 Jun. 22, 2017

(30) Foreign Application Priority Data

Dec. 17, 2015 (JP) ..... 2015-245891

(51) Int. Cl.

| | |
|---|---|
| ***H01H 13/705*** | (2006.01) |
| ***H01H 3/14*** | (2006.01) |
| ***H01H 13/704*** | (2006.01) |
| *H01H 13/703* | (2006.01) |

(52) U.S. Cl.

CPC ..... *H01H 13/705* (2013.01); *H01H 3/142* (2013.01); *H01H 13/704* (2013.01); *H01H 13/703* (2013.01); *H01H 2003/143* (2013.01); *H01H 2211/006* (2013.01)

(58) Field of Classification Search

CPC .... H01H 13/705; H01H 3/142; H01H 13/704; H01H 13/703; H01H 2211/006; H01H 2003/143

USPC ..... 200/512, 511, 514

See application file for complete search history.

(56) References Cited

U.S. PATENT DOCUMENTS

| | | | | |
|---|---|---|---|---|
| 4,963,705 A * | 10/1990 | Broderick | ..... | G08G 1/015 200/302.1 |
| 6,329,617 B1 * | 12/2001 | Burgess | ..... | H01H 3/141 200/512 |
| 7,190,355 B2 * | 3/2007 | Motoyama | ..... | H01H 13/702 178/18.03 |

FOREIGN PATENT DOCUMENTS

| | | |
|---|---|---|
| JP | 05-301589 | 11/1993 |
| JP | 2000-082358 | 3/2000 |
| JP | 2015-207455 | 11/2015 |

* cited by examiner

*Primary Examiner* — Edwin A. Leon
*Assistant Examiner* — Lheiren Mae A Caroc
(74) *Attorney, Agent, or Firm* — Allen Dyer Doppelt & Gilchrist

(57) ABSTRACT

A switch-containing cable when bended does not conduct electricity, but conducts electricity when pressurized with fingers. The cable has belt-like first and second oppositely disposed conductor films including respective first and second belt-like base materials on inner surfaces of which respective first and conductors are disposed; an insulating spacer arranged to maintain a gap therebetween; and a belt-like sheath configured with the first and second conductor films sandwiching the spacer and containing a belt-like conductor film functioning as a switch member in a hollow cavity. The first conductor film constituting the belt-like conductor film is movably overlaid on the insulating spacer, and the hollow cavity of the sheath includes a gap allowing for lengthwise relative displacement of at least the first belt-like base material caused by bending the sheath with respect to the belt-like conductor film housed in the hollow cavity, thereby preventing the cable from conducting electricity when bended.

4 Claims, 20 Drawing Sheets

SWITCH-CONTAINING CABLE

CROSS-REFERENCE TO RELATED APPLICATION

This application claims the benefit of Japanese Patent Application No. 2015-245891, filed on Dec. 17, 2015, the contents of which are herein incorporated by reference in their entirety.

FIELD OF THE INVENTION

The present invention relates to a switch-containing cable which, when bended, does not conduct electricity, but easily conducts electricity when pressurized with fingers, and is suitably used as, for example, a switch attached to earphones.

BACKGROUND OF THE INVENTION

In equipment such as portable music players, including CD and MD players, and personal digital assistants, users generally listen to sound using earphones or headphones. The equipment and an earphone are generally connected with a cable.

In this case, a control box used to perform the volume control and operation control of a player (selection of music numbers, switch-on/off, and the like) is usually disposed midway through the cable. The control box is provided with switches. In addition, an earphone body which incorporates wireless communications functions is provided with a switch.

A listener who uses earphones in portable equipment often uses the equipment while jogging or doing some sort of work. If, under these circumstances, the location of the switch is limited to one position of a cable at the time of performing switch operation, such as player control, the listener has to look for the position to operate the switch. This may lack swiftness and make the listener feel operationally cumbersome.

Accordingly, if the cable itself is allowed to have switch functions and easily placed in a conduction state by externally pressurizing the cable, the location of switching operation is not limited. This makes switching operation easy and provides excellent usability.

As such a cable, a cable is available in which two conductive members are vertically and oppositely disposed at a distance from each other, a conductive rubber is arranged between the conductive members within an outer cover, and the two conductive members are brought into contact with and made conductive to each other by external pressurization, so as to switch on the cable (Patent Literature 1).

In addition, a cable is available in which two conductive members covered with a conductive rubber are disposed at a distance from each other within an outer cover, and the two conductive members are brought into contact with and made conductive to each other by external pressurization (Patent Literature 2).

Yet additionally, there is available a cable switch provided with a belt-like first base material, and a second base material which is opposed to this first base material and in which a planar positive electrode is arranged on one side of an inner surface, a negative electrode is arranged on the other side, and a gap for separating and insulating these positive and negative electrodes from each other is formed between the electrodes, wherein substantially rectangular windows disposed at predetermined intervals in a length direction are formed by spacers arranged on the positive and the negative electrodes to make the positive and negative electrodes conductive to each other through the conductor (Patent Literature 3).

CITATION LIST—PATENT LITERATURE

Patent Literature 1: Japanese Patent Laid-Open No. 05-301589

Patent Literature 2: Japanese Patent No. 3447225

Patent Literature 3: Japanese Patent Laid-Open No. 2015-207455

The related arts of Patent Literature 1 and Patent Literature 2 have the problem in which a cable which is provided with or uses a conductive rubber decreases in resistance value due to bending, and may therefore cause unintended operation. The related arts also have the problem in which if the cable is bended rather than pressurized by hand, the electrodes may come into contact with and become conductive to each other and are, therefore, liable to false operation.

The related art of Patent Literature 3 does not cause unintended conduction even under the condition of use associated with bending. In the related art, however, the positive and negative electrodes are oppositely disposed on inner surfaces of one base material. In this case, the respective electrodes have to be formed into a corrugated or rectangular shape to face each other, and an insulating slit to be arranged between the electrodes also has to be formed into the same shape. Thus, the related art has the problem of being complex in configuration.

SUMMARY OF THE INVENTION

An object of the present invention, which has been proposed in view of the aforementioned problems, is to provide a switch-containing cable which allows an electrode structure to be easily formed, is less likely to be made conductive or not made conductive by bending deformation, but is easily made conductive by pressurization with fingers.

According to an embodiment of the present invention, a switch-containing cable is provided with a belt-like first conductor film including a first belt-like base material on an inner surface of which a first conductor is disposed; a belt-like second conductor film disposed oppositely to this first conductor film through a gap and including a second belt-like base material on an inner surface of which a second conductor is likewise disposed; an insulating spacer arranged between this second conductor film and the first conductor film to maintain a gap therebetween; and a belt-like sheath configured with the first and second conductor films between which this insulating spacer is held and containing a belt-like conductor film functioning as a switch member in a hollow cavity, wherein the first conductor film constituting the belt-like conductor film is movably overlaid on the insulating spacer, and the hollow cavity of the sheath includes a gap which allows for the lengthwise relative displacement of at least the first belt-like base material caused by bending the sheath with respect to the belt-like conductor film housed in the hollow cavity.

The cable, when bended, becomes displaced accordingly in the length direction with respect to the insulating spacer disposed on the second conductor film without deforming the first conductor film to the second conductor film side. In addition, since the insulating spacer for retaining a gap between the two conductor films is present therebetween, the first and second conductors do not come into contact with and become conductive to each other. Thus, the cable does not cause false operation.

According to an aspect of the present invention, a gap between the inner wall of the hollow cavity of the sheath and the belt-like conductor film is formed so as to be larger in a vicinity of the widthwise center of the belt-like conductor film than at the widthwise ends of the belt-like conductor film. A space is present between the belt-like conductor film and the inner wall of the sheath, and therefore, a stroke for the first and second conductor to come into contact with each other increases when the cable is pressurized. Thus, it is possible to configure a switch in which when the cable is pressed by a user with fingers, the user can readily recognize the feelings of switching.

According to another aspect of the present invention, lead wires are provided in lead wire insertion holes formed in the widthwise two ends of the sheath. It is possible to easily realize a switch-containing signal transfer cable.

According to a further aspect of the present invention, swelled parts are formed in the widthwise two ends of the sheath, a groove is formed between the swelled parts, a movable horizontally-long ring-shaped switching pressure member is disposed on the outer periphery of this sheath, and pressurizing protrusions for pressurizing the bottoms of the grooves by an external force are disposed in this switching pressure member. The swelled parts are formed in the sheath so that the cable does not conduct electricity even if the sheath itself is pressurized with fingers, the movable switching pressure member is disposed on the outer periphery of the sheath, and the pressurizing protrusions for pressurizing the sheath are disposed in this switching pressure member. Consequently, the switch can be localized to an optional position to turn on the cable.

BRIEF DESCRIPTION OF THE DRAWINGS

FIGS. 4A and 48 are cross-sectional explanatory views of the assembled belt-like conductor film;

FIG. 7A is a schematic perspective view of a switch-containing cable, whereas

DETAILED DESCRIPTION OF PREFERRED EMBODIMENTS

Figure 1:
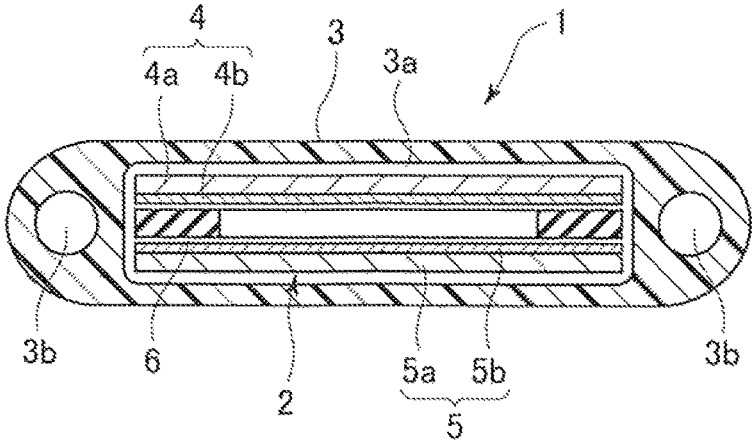
FIG. 1 is a vertical cross-sectional view of a first embodiment of the present invention.

FIG. 1 is a schematic vertical cross-sectional view illustrating the internal structure of a flat-type bendable switch-containing cable according to a first embodiment of the present invention.

This switch-containing cable 1 is provided with a belt-like conductor film 2 functioning as a switch; and a flat, tubular sheath 3 covering the outer periphery of this conductor film.

Under the illustrated condition, the belt-like conductor film 2 is composed of a first conductor film 4 located on the upper side of the cable, a second conductor film 5 disposed oppositely to this first conductor film 4 at a distance therefrom and located on the lower side of the cable, and an insulating spacer 6 arranged between these first and second conductor films 4 and 5.

The first conductor film 4 is composed of a first belt-like base material 4*a* made of an insulating member, and a first conductor 4*b* disposed on an inner surface (corresponding to the lower surface under the illustrated condition) of this first belt-like base material 4*a* in a belt-like manner.

The second conductor film 5 is composed of a second belt-like base material 5*a* also made of an insulating member, and a second conductor 5*b* disposed on an inner surface (corresponding to the upper surface under the illustrated condition) of this second belt-like base material 5*a* in a belt-like manner.

The insulating spacer 6 arranged between these first and second conductor films 4 and 5 serves to retain a gap between the conductor films, so that the belt-like base materials 4*a* and 5*a* of the conductor films do not come into contact with each other.

The flat, belt-like bendable sheath 3 is made from TPE (thermoplastic elastomer). This sheath 3 includes therein a substantially rectangular hollow cavity 3*a* through which the belt-like conductor film 2 composed of the first and second conductor films 4 and 5 and the insulating spacer 6 can be inserted. Note that the cross-sectional shape of the hollow cavity 3*a* is not limited to a rectangular shape. In addition, lead wire insertion holes 3*b* are preferably formed on both outer sides of the hollow cavity 3*a*, i.e., in the widthwise two ends of the sheath 3. This is because a signal transfer cable with a built-in switch can be easily obtained by inserting lead wires through these holes.

The hollow cavity 3*a* is formed so as to be larger than the external shape of the belt-like conductor film 2, so that the belt-like conductor film 2 can be housed in the cavity with adequate margins. Note that the width of the hollow cavity 3*a* has to be kept to a minimum to the extent that the insulating spacer 6 can maintain a gap between the first and second belt-like base materials 4*a* and 5*a*.

Figure 2:
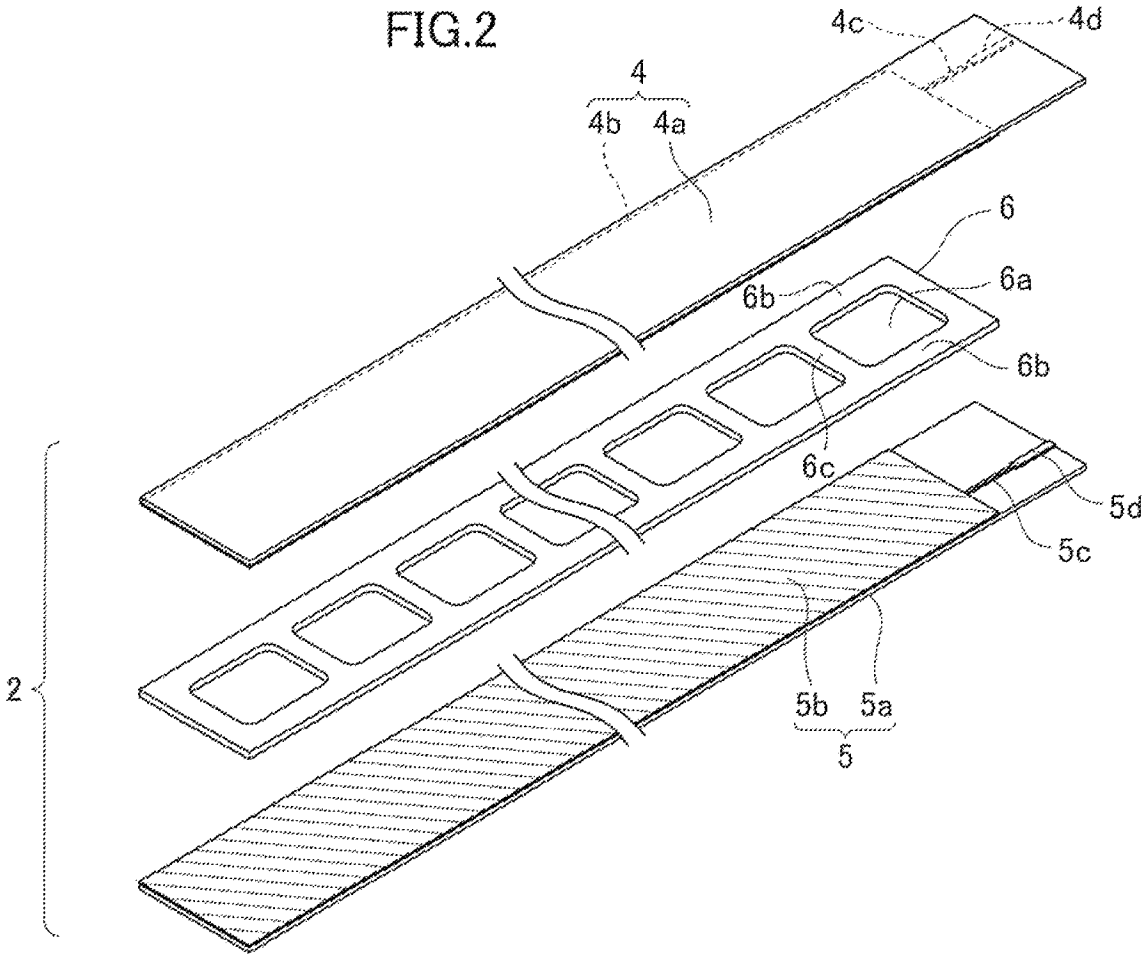
FIG. 2 is an explanatory view taken as a perspective view by disassembling the respective members of a belt-like conductor film used in the aforementioned embodiment of the present invention.

FIG. 2 is a perspective view of the respective members of the belt-like conductor film 2. The first conductor 4*b* is disposed on the inner surface of the first belt-like base material 4*a* constituting the first conductor film 4, and a lead 4*c* and a connecting electrode 4*d* are formed on an end of the first conductor 4*b*. The second conductor 5*b* is likewise disposed on the inner surface of the second belt-like base material 5*a* constituting the second conductor film 5, and a lead Sc and a connecting electrode 5*d* are likewise formed on an end of the second conductor 5*b*.

The insulating spacer 6 has a predetermined thickness, and windows 6*a* having, for example, a rectangular shape are formed into a ladder-like shape at predetermined intervals along the length direction of the spacer.

By way of example in the foregoing discussion, PET (polyethylene terephthalate) is used as the material of the first and second belt-like base materials 4*a* and 5*a*, and the film thickness and width of the base materials are preferably set to 100 μm and 3 mm, respectively. Alternatively, a heretofore-known substrate material for FPCs, such as PI (polyimide), may be used.

In the first and second conductors 4*b* and 5*b*, silver paste is printed on the inner surfaces of the first and second conductor films to form conductors across the entire lengthwise and widthwise ranges of intended portions, in order to provide switch functions. In addition, the connecting electrodes 4*d* and 5*d* are printed on ends of the inner surfaces of the first and second belt-like base materials 4*a* and 5*a*. Yet additionally, leads 4*c* and 5*c* are formed between these connecting electrodes 4*d* and 5*d* and the printed first and second conductors 4*b* and 5*b* to electrically connect the electrodes and the conductors.

As the insulating spacer 6, a 50 μm-thick polyester film is used. Alternatively, an insulator such as PI or paper, may be used. It is also possible to adopt solder resist or a coverlay used in commonly-known FPCs, in place of the insulating spacer 6 of this embodiment. An example of this alternative will be shown in Embodiment 3 to be discussed later.

In addition, the belt-like conductor film 2 is provided with 1 mm-wide sash bar-like insulators 6*c* for connecting insulators 6*b* formed on both lengthwise sides of the conductor 5*b* at 3.5 mm intervals. As a result, substantially rectangular windows 6*a* are formed at 3.5 mm intervals. This process is intended to arrange windows capable of stably holding the insulators 6*b* between and on both widthwise sides of the first and second conductors 4*b* and 5*b*, and causing the conductors of the conductor films 4 and 5 to come into contact with each other when the belt-like conductor film 2 is pressed with fingers. The shape of the windows is not limited, as long as the same effects are available.

Note that the insulating spacer 6 and the first and second conductor films 4 and 5 are set to the same width, so that the insulating spacer 6 is stably positioned between and on both widthwise sides of the first and second conductor films 4 and 5 under the condition that the insulating spacer and the conductor films are housed in the sheath 3.

The hollow cavity 3*a* inside the sheath 3 is set to 3.5 mm in cross-sectional width×0.8 mm in height, so as to have adequate margins in both width and height with respect to cross-sectional dimensions with the built-in insulating spacer 6 overlaid. Needless to say, respective members are set to optimum dimensions as appropriate, according to the size of the switch-containing cable 1.

Figure 3A:
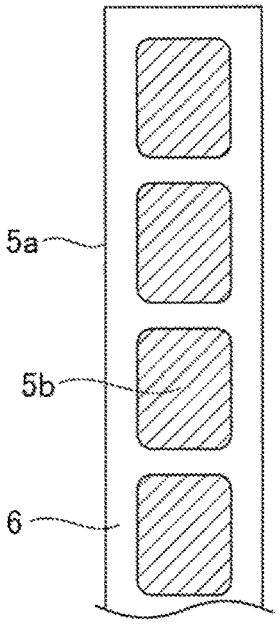
FIGS. 3A and 3B are explanatory views illustrating the assembly process of the belt-like conductor film.
Figure 3B:
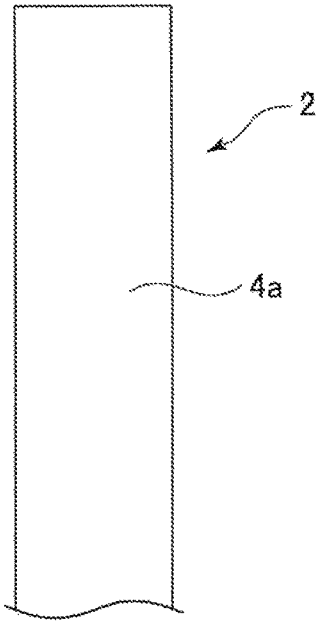

When the belt-like conductor film 2 is assembled, the insulating spacer 6 may be overlaid on the second conductor 5*b* of the second belt-like base material 5*a* as illustrated in FIG. 3A, and the first belt-like base material 4*a* may be overlaid on the insulating layer as illustrated in FIG. 3B. That is, the first belt-like base material 4*a* is made movable in the length direction with respect to the insulating spacer 6 in a portion where at least the conductors on the first and second conductor films 4 and 5 can have contact with each other, simply by overlaying the base material 4*a*. Thus, the first belt-like base material 4*a* is neither fixed to nor integrated with the insulating spacer 6.

Figure 4A:
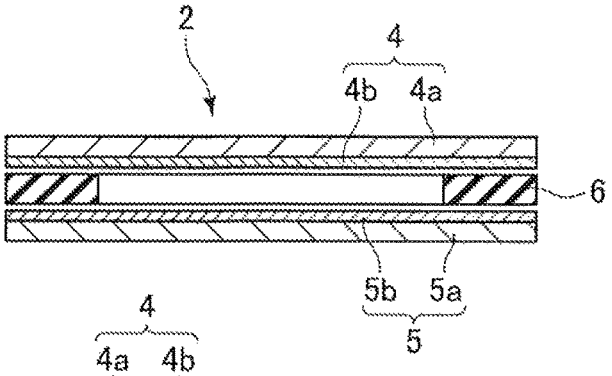
Figure 4B:
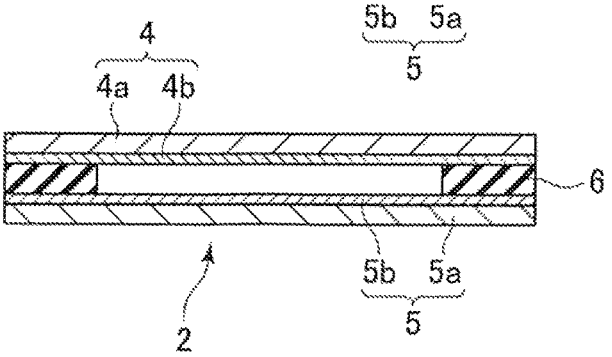

FIG. 4A illustrates a schematic side cross-section of the assembled belt-like conductor film 2. This FIG. 4A and FIG. 1 shown above illustrate the condition under which the insulating spacer 6 is overlaid on the second conductor 5*b* without being joined thereto, and the first belt-like base material 4*a* is overlaid on the insulating spacer. Gaps are shown among respective members in the figures, in order to indicate that the respective members are neither joined nor fixed. In practice, however, the respective members are stacked on top of another under the condition shown in FIG. 48.

Figure 5:
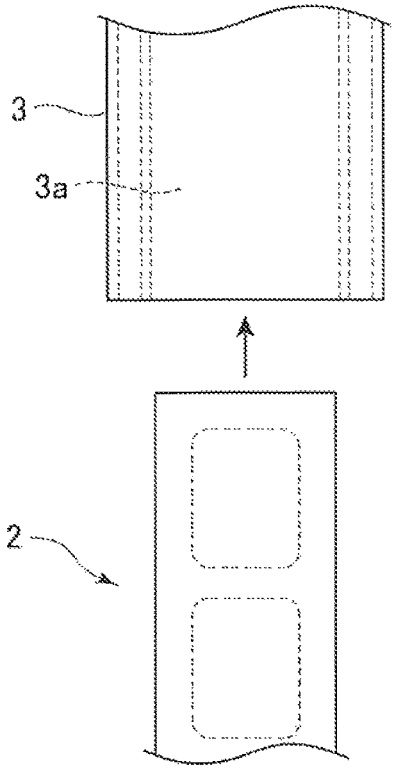
FIG. 5 is an explanatory view of the way the assembled belt-like conductor film is contained in a sheath.
Figure 6:
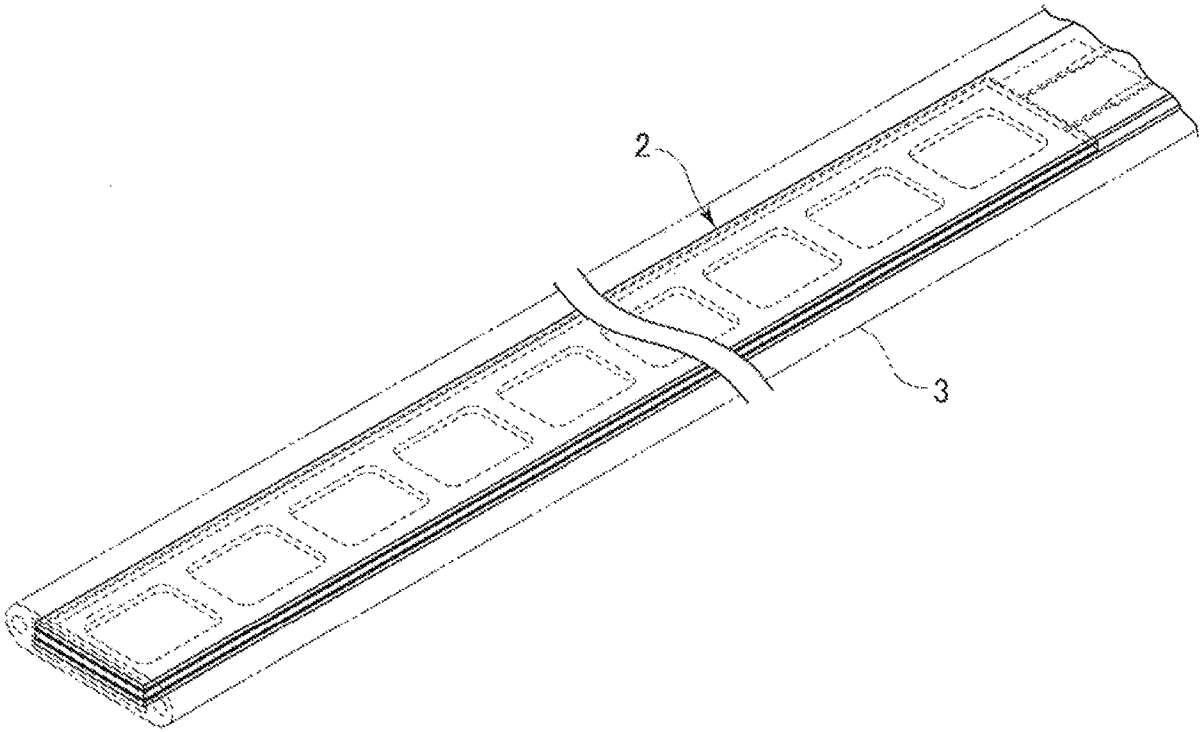
FIG. 6 is a schematic perspective view illustrating the belt-like conductor film contained in the sheath.

The assembled belt-like conductor film 2 is housed in the hollow cavity 3*a* of the sheath 3, as illustrated in FIG. 5. FIG. 6 is a schematic perspective view in which the belt-like conductor film 2 is contained in the hollow cavity 3*a* of the sheath 3. The sheath 3 in which the belt-like conductor film 2 is contained is bendable. In this case, a lengthwise displacement between the first and second conductor films 4 and 5 has to be allowed for in at least a switching portion (portion where the first and second conductors 4*b* and 5*b* face each other), in order for the conductor films to have a cylindrical lateral side shape when bended. If the belt-like conductor film 2 is housed in the sheath 3 without being fixed at all, however, the lengthwise positions of the first and second conductor films 4 and 5 may become significantly displaced up to such positions where the conductor films do not face each other. In addition, there arises the problem of workability when the belt-like conductor film 2 is inserted in the sheath 3. Accordingly, the respective conductor films are fixed at lengthwise ends with, for example, a pressure sensitive adhesive or a double-sided adhesive tape (not illustrated) in the present embodiment. Note that it is not essential to fix the conductor films 4 and 5, if the conductors 4*b* and 5*b* of the conductor films can be held within a predetermined range under the condition of being contained in the sheath 3 by setting the length of the hollow cavity 3*a* of the sheath 3.

Figure 7A:
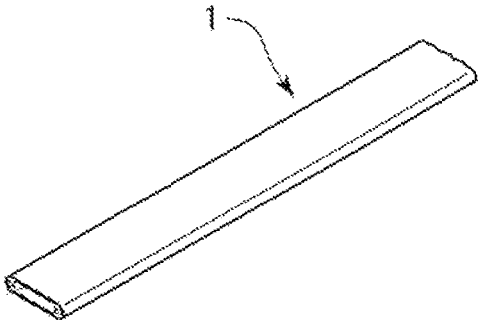
Figure 7B:
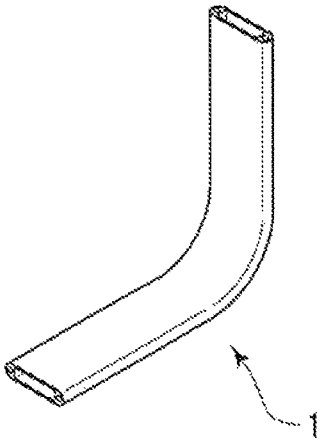
FIG. 7B is a schematic perspective view of the switch-containing cable in a bent state.

FIG. 7A is a schematic perspective view of a completed belt-like switch-containing cable 1. This switch-containing cable 1 is bendable at any portion thereof, as illustrated in FIG. 7B.

Figure 8:
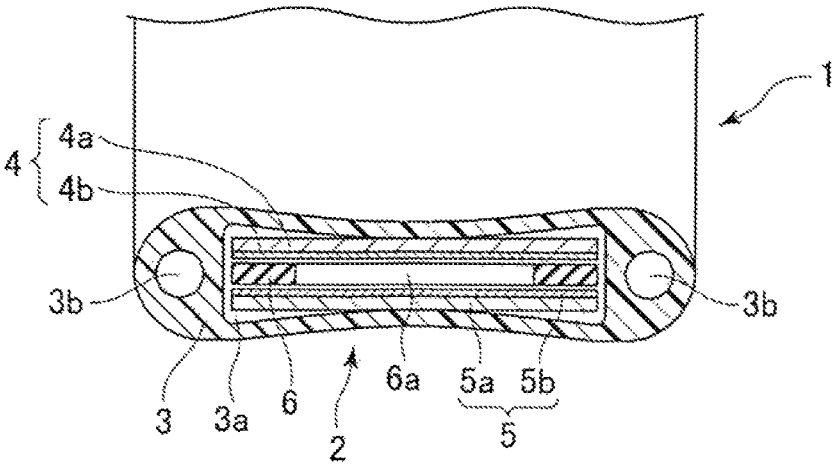
FIG. 8 is an explanatory view illustrating a state of the belt-like conductor film under the condition of the switch-containing cable being bended.

FIG. 8 illustrates a state of the belt-like conductor film 2 when the switch-containing cable 1 is bended. The present invention has the characteristic of not allowing the first conductor 4*b* and the second conductor 5*b* in a bent state to come into contact with each other to perform switching operation.

That is, in the belt-like conductor film 2 contained in the sheath 3 to function as a cable switch, at least two materials, i.e., the first and second belt-like base materials 4*a* and 5*a* including the conductors 4*b* and 5*b* on the inner surfaces are used and stacked oppositely to each other, with the insulating spacer 6 held therebetween, at such an space interval as not to come into contact with each other. At that time, the insulating spacer 6 for maintaining a specific space interval is disposed on both widthwise sides of a portion where the first and second conductors 4*b* and 5*b* of the belt-like conductor film 2 face each other. In addition, the conductor films 4 and 5 and the insulating spacer 6 are not fixed so as to be able to allow for a lengthwise relative displacement between the first conductor film 4 and the second conductor film 5 in at least a portion which functions as a cable switch, i.e., the portion where the first and second conductors 4*b* and 5*b* of the belt-like conductor film 2 face each other. If the cable is configured as described above, the first and second conductor films 4 and 5 take cylindrical lateral side shapes high in shape rigidity in the portion where the first and second conductors 4*b* and 5*b* of the belt-like conductor film 2 face each other, even if the cable is bended. Accordingly, a gap as large as the thickness of the insulating spacer 6 is secured between the respective conductors by the insulating spacer 6 present in portions corresponding to the upper and lower parts of each cylindrical lateral side. Thus, the conductors do not come into contact with each other to conduct electricity, and therefore, it is possible to prevent false operation due to bending.

In addition, in order to prevent the first and second conductors 4*b* and 5*b* from coming into contact with each other when the cable is bended with the belt-like conductor film 2 contained in the sheath 3, the belt-like conductor film 2 is housed in the sheath 3 with adequate margins, so as to be able to allow for a lengthwise displacement in the vicinity of the portion where the conductors 4*b* and 5*b* face each other.

When the switch-containing cable is bended by an external force under this condition, both the first conductor film 4 and the second conductor film 5 take a cylindrical lateral side shape in the bent portion, as described above. The gap between the conductor films 4 and 5 is secured, however, by the insulating spacer 6 present in portions located in the upper and lower parts of each cylindrical lateral side. In addition, the bend radius of the conductor film 4 on the inner side of bending is shorter than the bend radius of the conductor film 5 on the outer side of bending in the bent portion. Consequently, a lengthwise displacement as large as the radius difference arises between the first and second conductor films 4 and 5. That is, the first conductor film 4 positioned on the inner side of bending is displaced farther in a direction away from the bent portion than the second conductor film 5 positioned on the outer side of bending. Accordingly, the first conductor 4*b* and the second conductor 5*b* do not come into contact with each other to conduct electricity.

Figure 9:
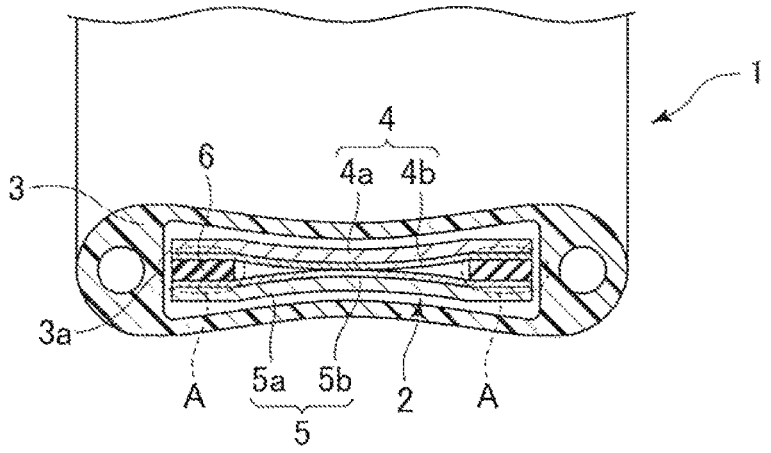
FIG. 9 is an explanatory view of the operation of the switch-containing cable when an insulating spacer and conductor films on the upper and lower sides of the insulating spacer constituting the switch-containing cable are fixed.

Note that if the first and second conductor films 4 and 5 are fixed to the insulating spacer 6, as illustrated in FIG. 9 by enclosing with dashed-line ovals A, so as not to become displaced in the length direction, the lengthwise displacement is no longer allowed for. Consequently, a force for the respective conductors to deform in a direction in which the conductors come into contact with each other arises in the bent portion at the time of bending due to a difference in circumferential length between the inner and outer sides of bending in the first and second conductor films 4 and 5. Thus, bending causes switch functions to work without intension.

Figure 10:
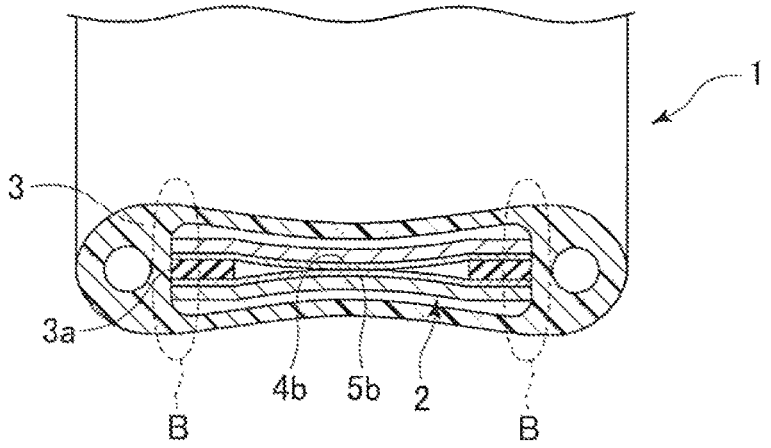
FIG. 10 is an explanatory view of the operation of the switch-containing cable when the side edges of the conductor films constituting the switch-containing cable are fixed to the inner wall of the sheath.

In addition, under the condition that the side edges of the first and second conductor films 4 and 5 are fixed to the inner wall of the sheath between the two lateral portions of the belt-like conductor film 2 and the inner wall of the hollow cavity 3*a* opposed to the lateral portions, as illustrated in FIG. 10 by enclosing with dashed-line ovals B, the opposed first and second conductors 4*b* and 5*b* are also liable to deformation in a direction in which the conductors come into contact with each other at the time of bending. Thus, the conductors may conduct electricity to cause false operation.

Accordingly, in the present invention, the inside dimensions of the hollow cavity 3*a* of the sheath 3 in the thickness direction thereof are set to large values with respect to the thickness of the belt-like conductor film 2 contained in the sheath 3, as described above, so that at least the occurrence of displacement in assumed bending is tolerated. That is, such a gap as being capable of stress-freely tolerating any wavy sections arising in portions other than the bent portion in case of displacement is provided in the thickness direction of the cable, in order to tolerate displacement within the sheath 3 under the condition that the conductor films 4 and 5 are fixed at ends thereof as in the present embodiment.

Figure 11:
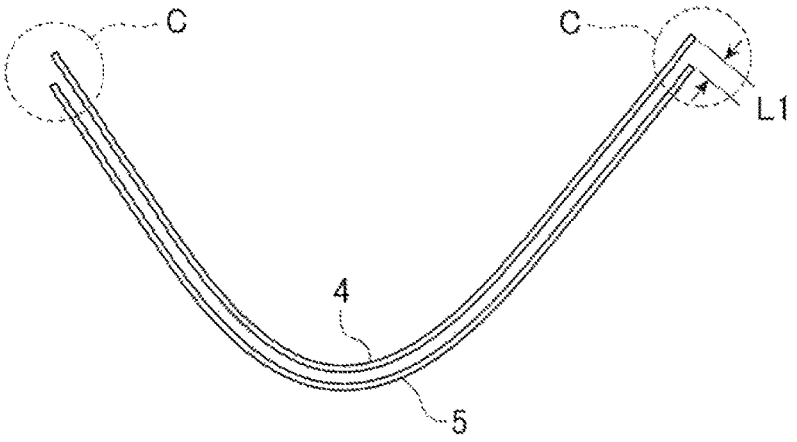
FIG. 11 is an explanatory view of the bent state of the switch-containing cable when the ends of the first and second conductor films are not fixed.

More specifically, if ends of the conductor films 4 and 5 are not fixed as illustrated in FIG. 11, the conductor films do not become wavy since a shift arises between the conductor films 4 and 5 in portions C enclosed with dashed-line circles at the time of bending, as shown by a length L1 between arrows.

Figure 12:
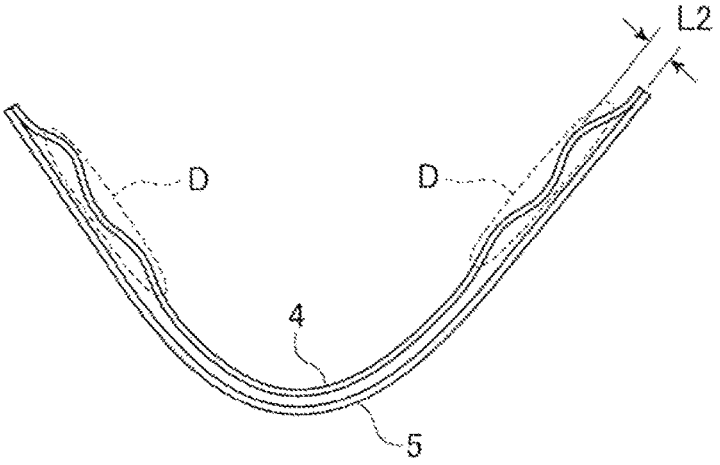
FIG. 12 is an explanatory view of the bent state of the switch-containing cable when the ends of the first and second conductor films are fixed.

If ends of the conductor films 4 and 5 are fixed as illustrated in FIG. 12, however, the inner-side conductor film 4, when bended, has flexure as illustrated in dashed-line ovals. Thus, wavy sections arise as shown by a reference character L2. For this reason, a gap capable of tolerating the thickness L2 of the wavy sections is provided in the hollow cavity 3*a* of the sheath 3 in the thickness direction of the cable.

Note that when the cable is bended, the sheath 3 itself always deforms toward a direction of switching operation even if the internal first and second conductor films 4 and 5 have high rigidity and a cylindrical shape and the conductors 4*b* and 5*b* can be kept in a non-contact state. This means that if the sheath 3 is high in the degree of deformation or thick and high in deformation pressure, the rigidity of the cylindrical lateral side shape of the first and second conductor films 4 and 5 may be exceeded, thus possibly making it no longer possible to maintain the gap between the conductors 4*b* and 5*b*. Accordingly, in order to prevent false operation, the rigidity of the cylindrical portion needs to be set so as not to underrun the deformation pressure of the sheath even if actual (or assumed) deformation occurs. As a method for doing so, the sheath 3 may be made soft and thin and the conductor base materials may be made thick and stiff. The abovementioned degree depends on a tradeoff among respective constituent elements, however. Accordingly, solutions to this part of discussion may be obtained by experiment and/or simulation using a finite element method or the like.

Figure 13:
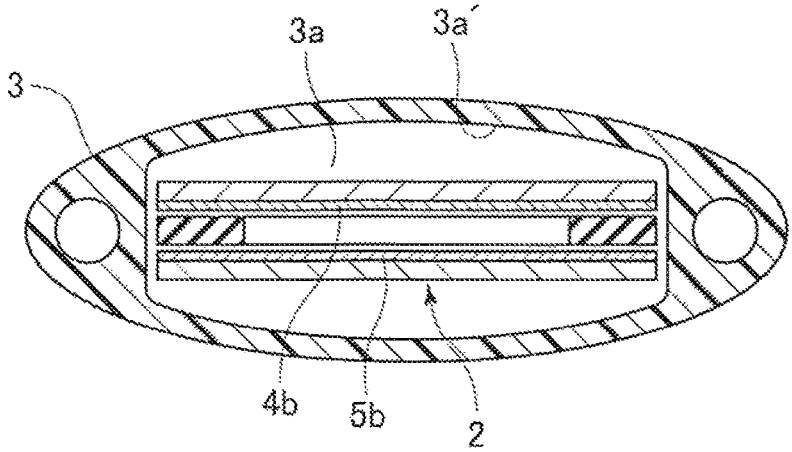
FIG. 13 is an example in which a gap between an inner wall of the sheath and a belt-like conductor film is formed so as to be larger in the vicinity of the widthwise center of the belt-like conductor film than in the vicinity of the widthwise ends of the belt-like conductor film.

FIG. 13 is an example in which a gap between the upper and lower surfaces of the belt-like conductor film 2 and the inner walls of the hollow cavity 3*a* of the sheath 3 is formed so as to be larger in the vicinity of the widthwise center of the sheath 3 than in the vicinity of the widthwise ends of the sheath 3.

As one specific example, the height of the hollow cavity 3*a* of the sheath 3 is set to 0.8 mm at the ends of the first and second conductor films 4 and 5 and to 1.3 mm at the central portions thereof. According to these settings, a stroke for the first conductor 4*b* of the first conductor film 4 and the second conductor 5*b* of the second conductor film 5 to come into contact with each other increases at the time of pressurization. Thus, it is possible to configure a switch in which when the cable is pressed by a user with fingers, the user can readily recognize the feelings of switching.

Figure 14:
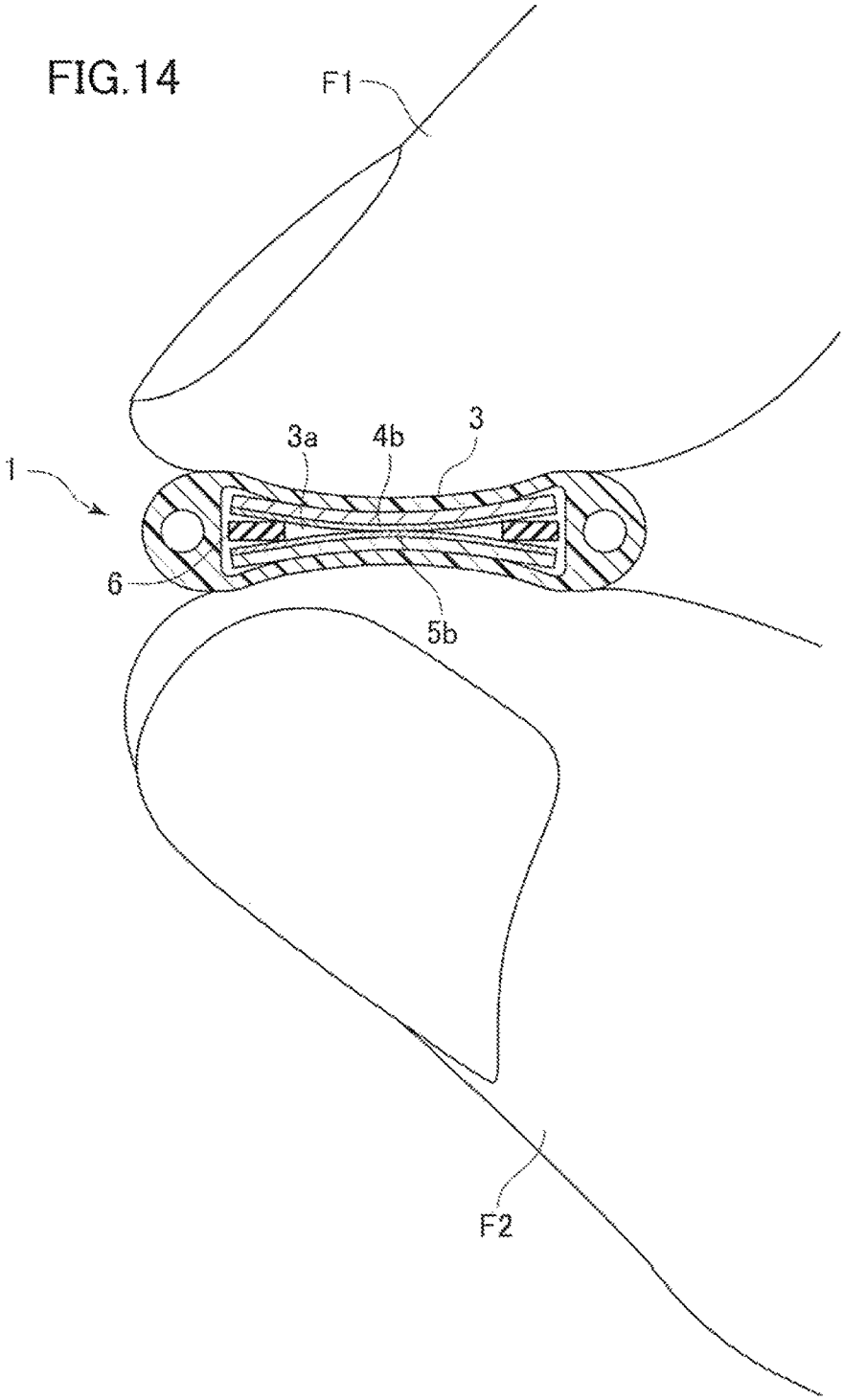
FIG. 14 is an explanatory view of the operation of the switch-containing cable pressurized with fingers.

FIG. 14 illustrates a case in which the upper and lower surfaces of the switch-containing cable 1 are pinched and pressed with, for example, a forefinger F1 and a thumb F2 to squeeze the sheath 3. Assuming, for example, that the first conductor 4*b* is a positive electrode and the second conductor 5*b* is a negative electrode, the conductors 4*b* and 5*b* come into contact with each other at a central part within a window of the insulating spacer 6 due to pressurization with fingers and conduct electricity.

Figure 15A:
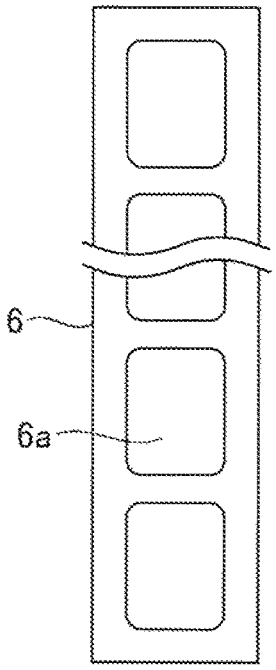
FIGS. 15A, 15B and 15C are schematic explanatory plan views of examples of insulating spacers that can be used in the present invention.
Figure 15B:
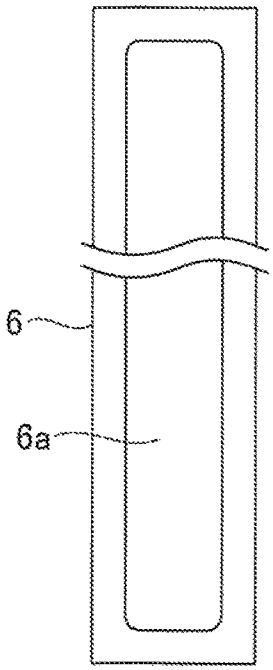
Figure 15C:
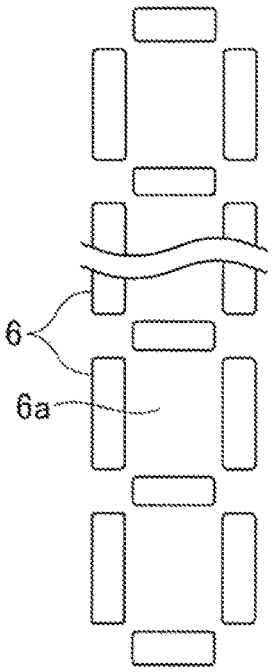

FIG. 15 illustrates modified examples of the window shape of the insulating spacer 6. FIG. 15A is an example of forming the window shape into a commonly-used rectangle. FIG. 15B is an example of forming the window shape into an elongated rectangle. FIG. 15C is an example of separating liner portions and sash bar-like coupling portions to form the window shape into a segmented pattern. Alternatively, the window shape may be formed into, for example, a track shape or an oval. Note that the window shape makes it possible to adjust the sensitivity of the cable as a switch with respect to press with fingers. That is, a large window portion can set the cable to high sensitivity (operable at low voltages), whereas a small window portion can set the cable to low sensitivity (operable at high voltages). In addition, increasing the number of windows in the length direction (increasing the number of insulators among windows) can set the cable to low sensitivity, whereas decreasing the number can set the cable to high sensitivity.

Figure 16:
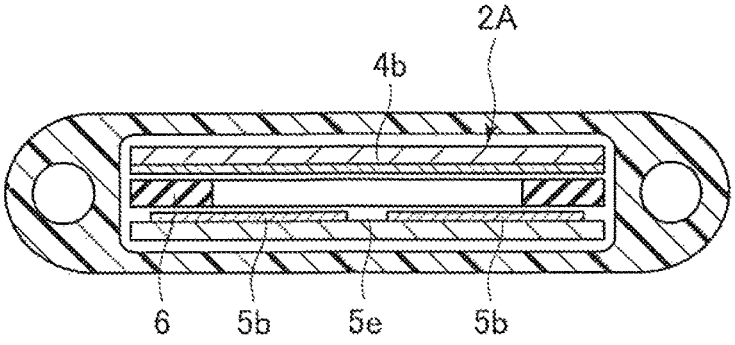
FIG. 16 is a vertical cross-sectional view of a second embodiment of the present invention.

FIG. 16 illustrates a second embodiment of the present invention. In this embodiment, a slit 5*e* is formed in the center of the second conductor 5*b* on the lower side of the belt-like conductor film 2A under the condition, for example, shown in the figure, to form the second conductor 5*b* into a dual-partitioning structure. Thus, the second embodiment has the characteristic that one of the partitioned portions of the conductor 5*b* is defined as a +electrode, the other partitioned portion is defined as a −electrode, and the opposed first conductor 4*b* is defined as a jumper part.

Figure 17:
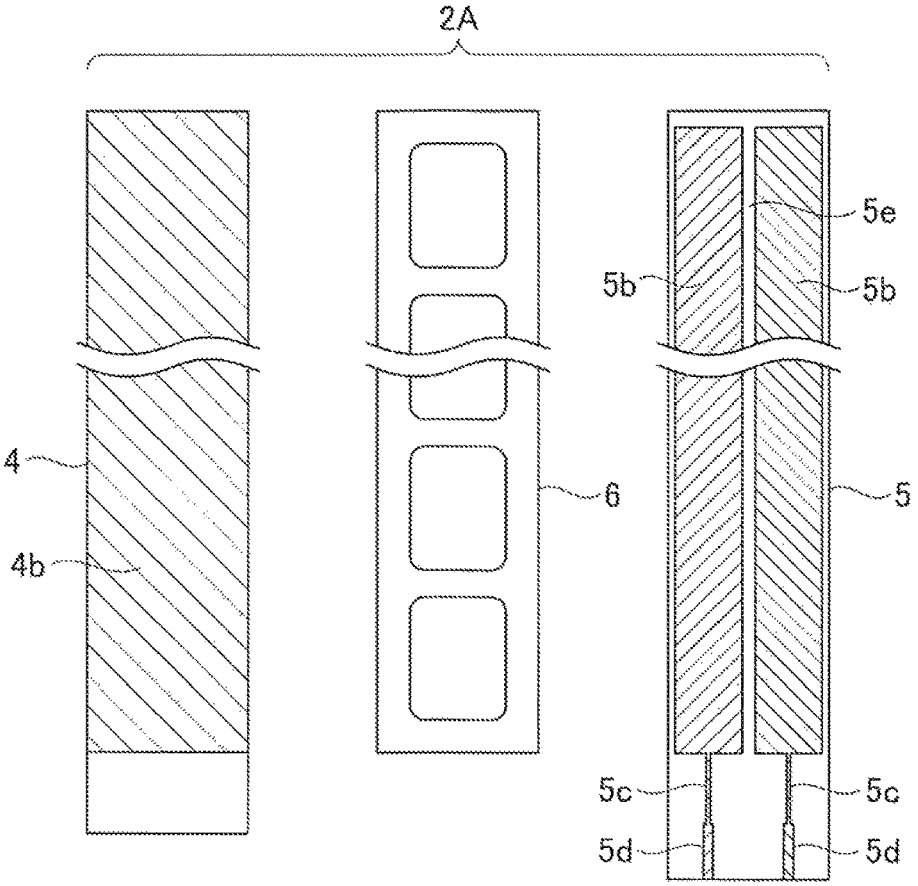
FIG. 17 is a schematic plan view in which the belt-like conductor film of the aforementioned embodiment is expanded.

FIG. 17 is a schematic view in which a belt-like conductor film 2A of the second embodiment is expanded into respective members. Since the second conductor 5*b* has a dual-partitioning structure composed of the linear +electrode and −electrode, leads 5*c* and connecting electrodes 5*d* are disposed on both ends of the conductors 5*b*. Accordingly, leads and connecting electrodes need not be provided in the first conductor 4*b* of the first conductor film 4. In the first embodiment, the connecting electrodes 4*d* and 5*d* are disposed on the first and second conductors 4*b* and 5*b*, respectively, as illustrated in FIG. 2. In contrast, a pair of connecting electrodes are disposed only on one conductor film in this embodiment, and therefore, a connecting portion is limited to one place. Thus, the present embodiment has the advantage of being able to reduce the number of connectors and the size thereof.

The present embodiment is the same in the structure of the insulating spacer 6 as the first embodiment. When the insulating spacer 6 is overlaid on the second conductor film 5, the slit 5*e* is positioned in the central portion of a window 6*a*, and the second conductors 5*b* become exposed on both sides of the slit 5*e*. Thus, the first conductor 4*b* can be brought into contact with the second conductors 5*b* by press.

As a matter of course, the first conductor 4*b* may alternatively be formed into a dual-partitioning structure having + and − polarities.

The present embodiment is the same in the rest of configuration and working effect as the first embodiment.

Figure 18:
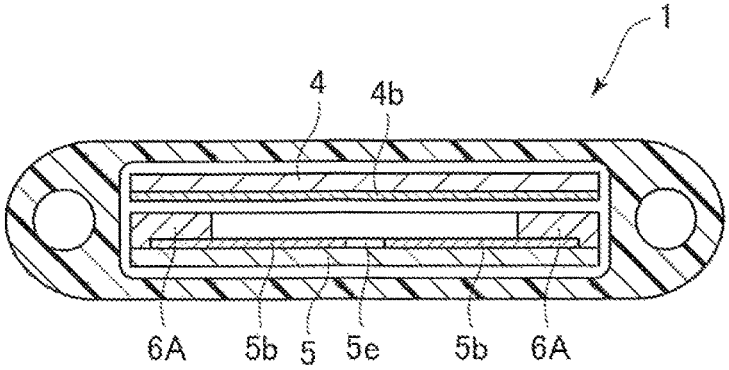
FIG. 18 is a vertical cross-sectional view of a third embodiment of the present invention.

FIG. 18 illustrates a third embodiment of the present invention. This embodiment has the characteristic that in the second embodiment, insulating spacers 6A are formed on the dual-partitioning second conductors 5*b* using resist. In this case, it is desirable to adopt a method of applying solder resist, a coverlay or the like used in commonly-known FPCs. That is, resist or a coverlay is directly joined and fixed to a base material or a conductor through an adhesive agent. Accordingly, resist or a coverlay for use in FPCs for which bending is assumed is formed to be sufficiently thinner than a base material using a flexible material, so that when in use, any excessive stress is not applied to a conductor or the base material when a conductor film is deformed and that an insulator is not partially delaminated off. In addition, a cable of resist type need not be integral like a cable of spacer type, but may be provided with segmented portions, as illustrated in FIG. 15C. This way of configuration has the effect of allowing stress arising in the conductor film to which resist is fixed to decrease when bending takes place, making it easy to form a cylindrical lateral side shape, and preventing false operation. Care must be taken, however, not to enlarge gaps more than necessary to make it easy for respective conductor films to come into contact with each other at the time of bending.

Figure 19:
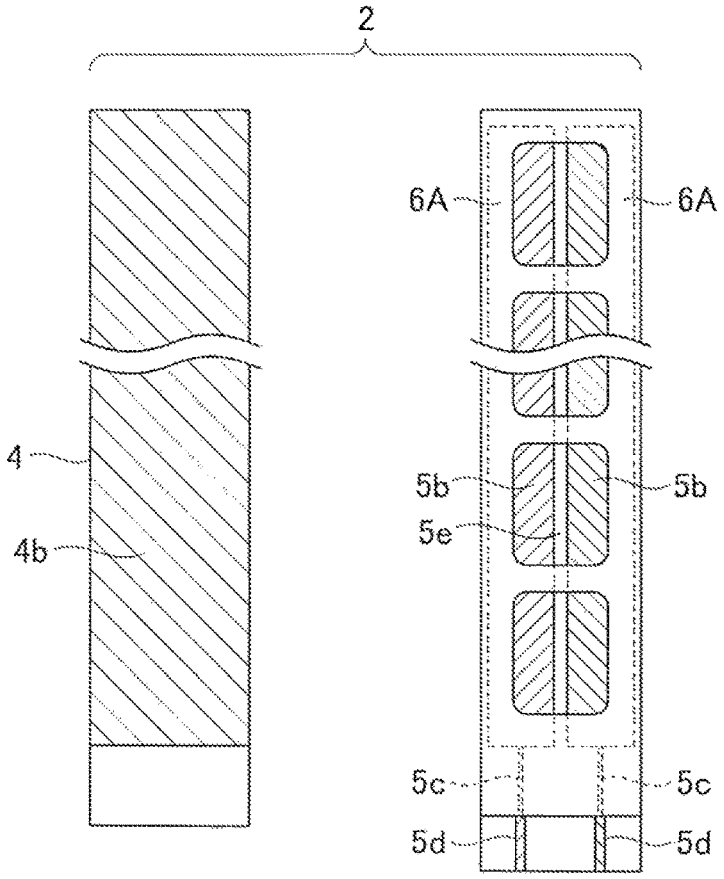
FIG. 19 is a schematic plan view in which the belt-like conductor film of the aforementioned embodiment is expanded.

FIG. 19 illustrates an expanded state of the belt-like conductor film 2.

Figure 20:
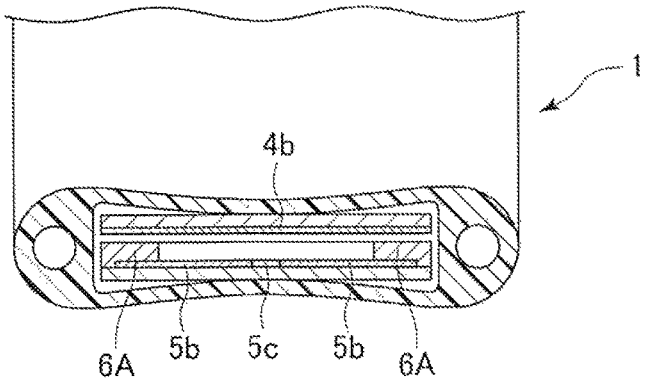
FIG. 20 is an explanatory view of the operation of the third embodiment in a bent state.

The present embodiment is the same in the rest of configuration as the second embodiment. Such a switch-containing cable 1 as described above, even if bended, does not cause the first conductor 4*b* overlaid on the insulating spacer 6A to come into contact with the second conductors 5*b*, as in the first and second embodiments. Note that FIG. 20 illustrates the condition that bending has taken place in the third embodiment.

Figure 21:
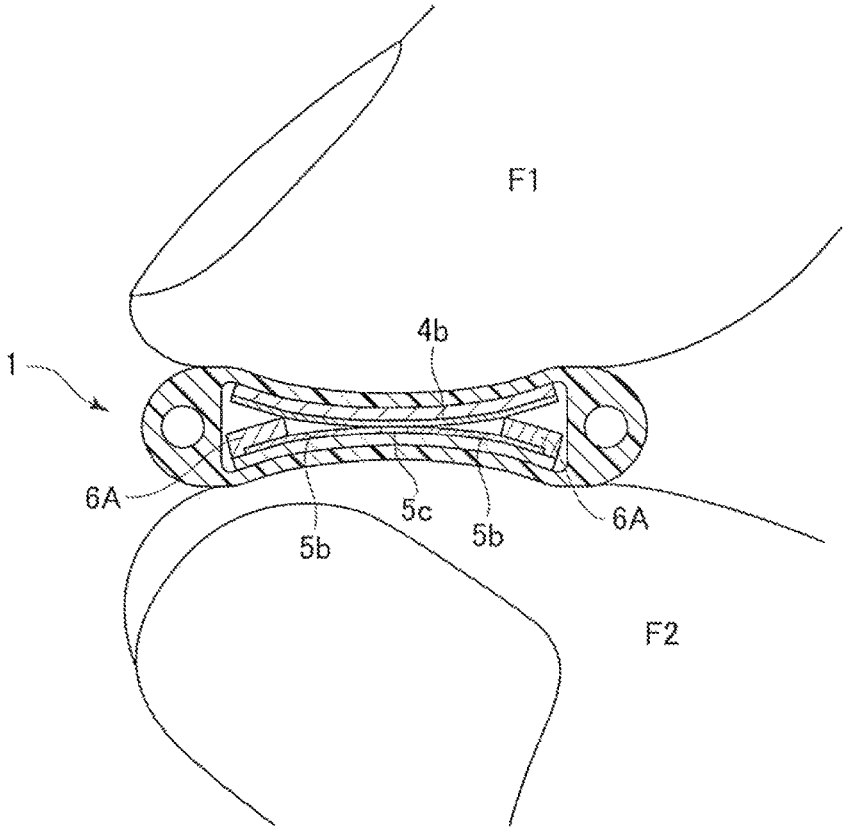
FIG. 21 is an explanatory view of the operation of the third embodiment pressurized with fingers.

FIG. 21 illustrates the condition that the switch-containing cable 1 of the third embodiment is pressurized with fingers to bring the central portion of the first conductor 4*b* into contact with the second conductors 5*b* to conduct electricity.

Figure 22:
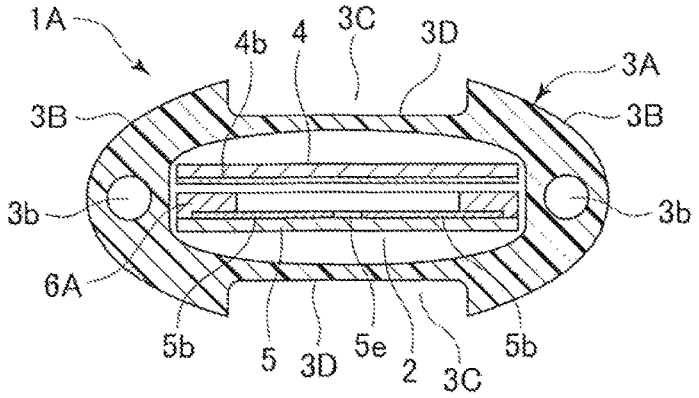
FIG. 22 is a vertical cross-sectional view of the switch-containing cable of a fourth embodiment of the present invention.

FIG. 22 illustrates a fourth embodiment of the present invention. In the first to third embodiments described above, any lengthwise portions of the switch-containing cable can be pressurized with fingers to conduct electricity. This embodiment has the characteristic, however, that the cable is allowed to conduct electricity only at a predetermined position.

That is, in this embodiment, outward-swelled parts 3B are disposed at both ends of a sheath 3A constituting a switch-containing cable 1A, and a groove 3C is formed between the swelled parts. These swelled parts 3B and grooves 3C are disposed across the entire sheath 3A in the length direction. These swelled parts 3B function as conduction-preventing members for preventing a pressurizing force from being applied to the first and second conductor films 4 and 5 of a belt-like conductor film and thereby maintaining a non-conducting state, when the sheath 3A is pressurized with a pressurizing object, such as fingers. On the other hand, the grooves 3C have the function of bringing the first and second conductor films 4 and 5 into contact with each other to conduct electricity as the result of pressurizing parts 3D in the bottoms of the grooves being pressurized by later-described pressurizing protrusions 7B inserted through the grooves 3C. Each groove 3C also functions as a groove for guiding a pressurizing protrusion 7B slidable within the groove. In the illustrated example, each swelled part 3B is formed into a cross-sectionally bombshell-like shape projecting in the width direction. Alternatively, each swelled part 3B may have a rectangular shape the corners of which are rounded, or other shapes. These alternatives will be shown in FIGS. 30 and 31.

Figure 23:
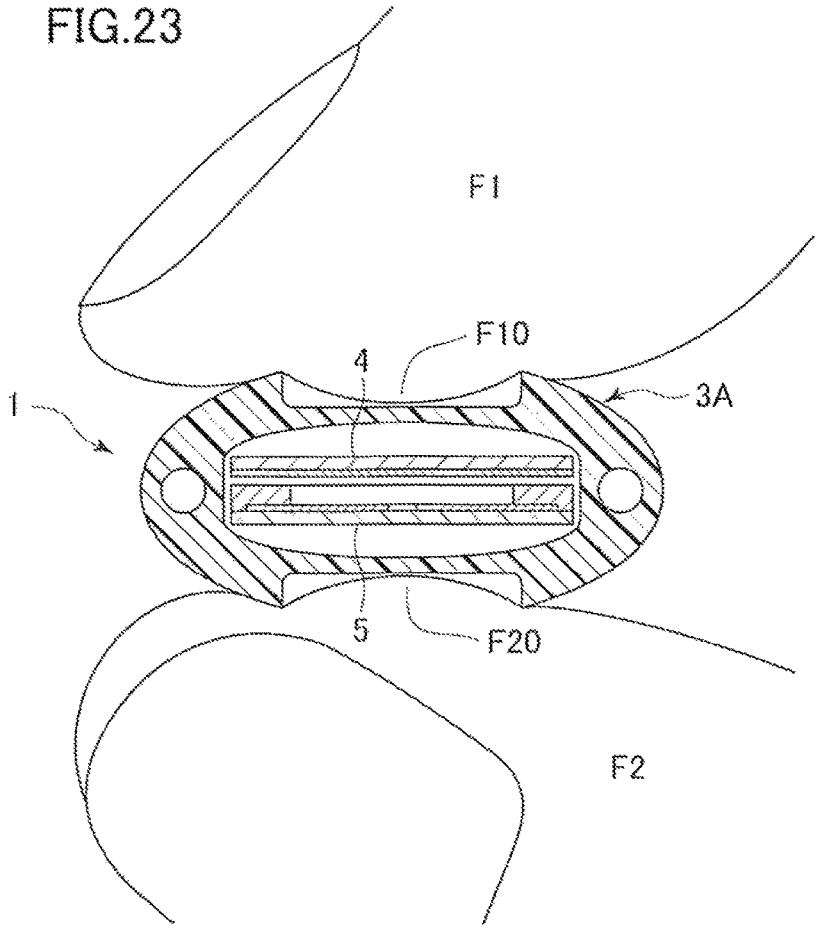
FIG. 23 illustrates the condition of the switch-containing cable of the fourth embodiment being pressurized with fingers.

FIG. 23 illustrates the condition that the switch-containing cable of the fourth embodiment is pinched and pressurized with a forefinger F1 and a thumb F2. In this case, the swelled parts 3B are rigid for reasons of their thick-walled shape and material, and therefore, the sheath 3A does not deform in these parts. At this time, balls F10 and F20 of the forefinger F1 and the thumb F2 are not put under pressure though the balls F10 and F20 get inside the grooves 3C. The balls therefore do not pressurize the pressurizing parts 3D even if the balls come into contact with the pressurizing parts 3D in the bottoms of the grooves. In addition, even if the sheath 3A becomes deformed, it is the spacer onto which pressing force is directly applied, and therefore, no contact takes place between respective conductors. Accordingly, the first and second conductor films 4 and 5 do not go into a conduction state. Note that in the illustrated example, the belt-like conductor film 2 corresponds to that of the third embodiment illustrated in FIG. 18. The same members will therefore be denoted by the same reference numerals and characters from the viewpoint of avoiding overlapping discussions. As a matter of course, the belt-like conductor film 2 may be those of the first and the second embodiments.

Figure 24:
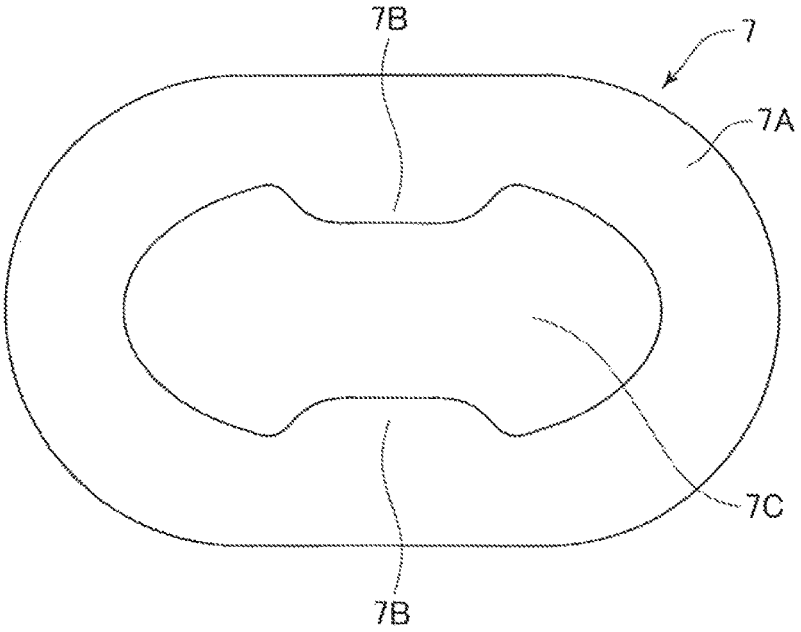
FIG. 24 is a side view of a switching pressure member used in the fourth embodiment.

FIG. 24 is a side view of a switching pressure member used in combination with the sheath 3A. A switching pressure member 7 is formed into a horizontally-long ring-like shape according to the shape of the sheath. This switching pressure member 7 is provided with a ring-shaped pressurizing part 7A movably disposed on the outer periphery of the sheath 3A, and pressurizing protrusions 7B protrusively disposed in the inner central part of this ring-shaped pressurizing part 7A and positioned within the grooves 3C. The internal shape of a spatial part 7C inside the ring-shaped pressurizing part 7A corresponds to the external shape of the sheath 3A.

Figure 25:
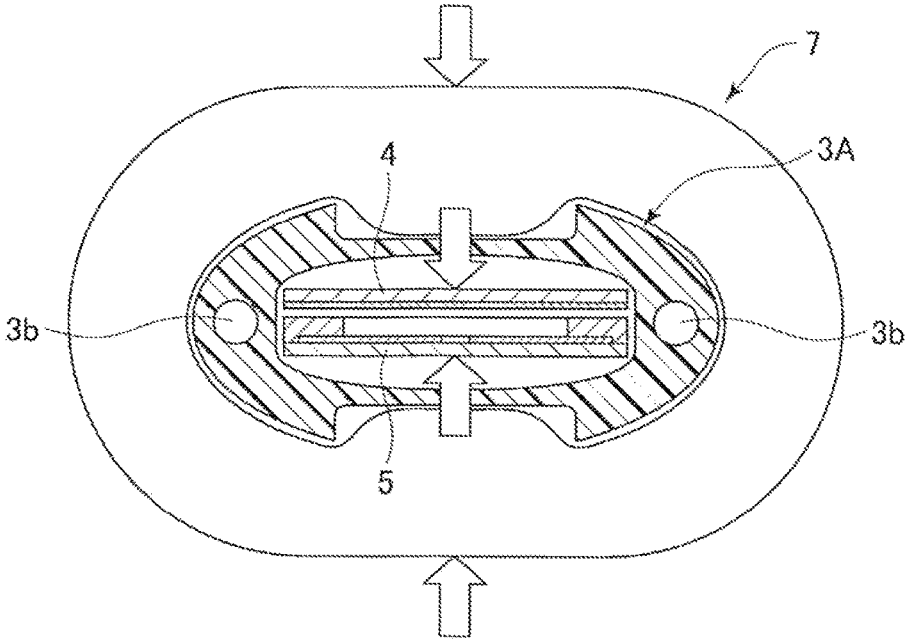
FIG. 25 is an explanatory view of the operation of the fourth embodiment.
Figure 26:
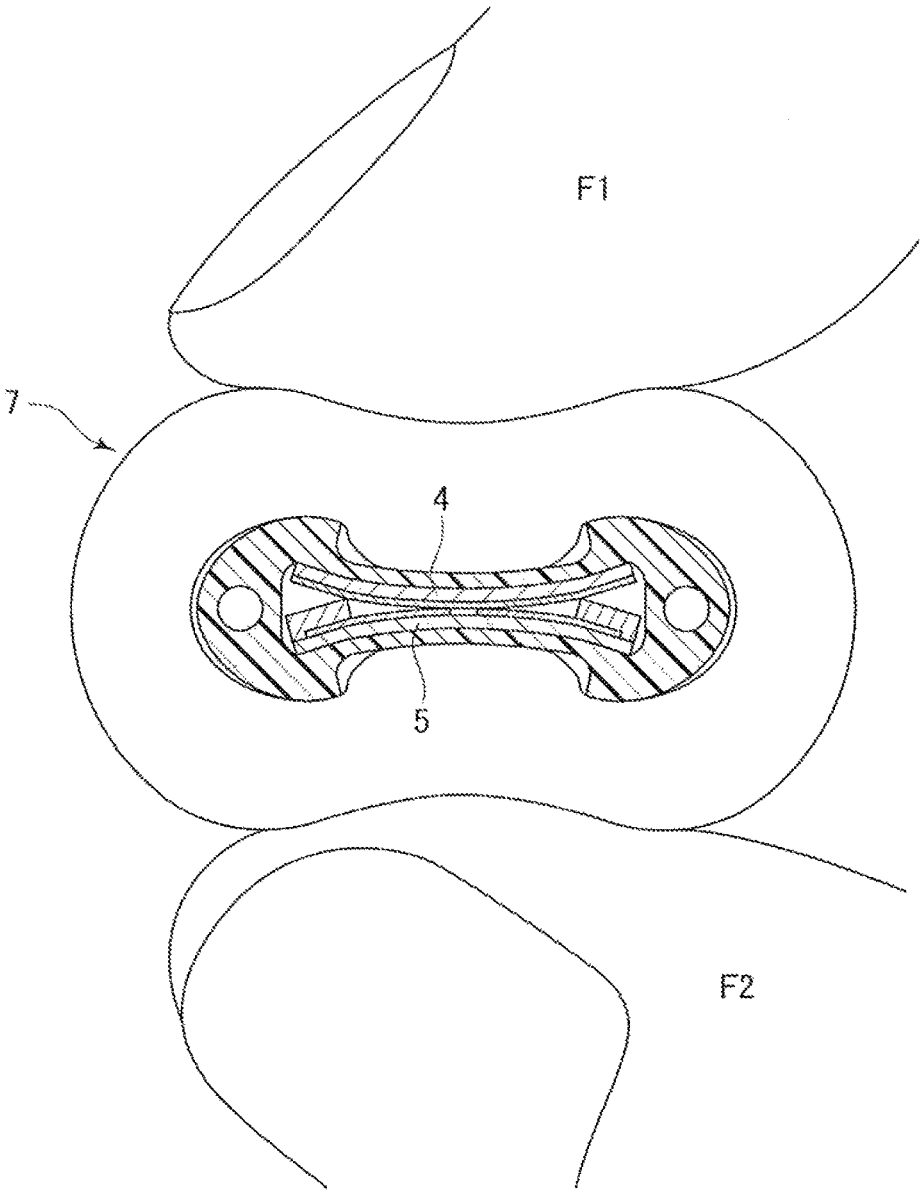
FIG. 26 is an explanatory view of the operation of the switch-containing cable of the fourth embodiment pressurized with fingers.

As the material of the switching pressure member 7, a soft, easy-to-deform material such as TPE may be used. Alternatively, a hard material such as rigid plastic or metal may be used. The hard material may be applied as long as the material is thin-walled and pressure-deformable except portions thereof near the pressurizing protrusions 7B. The sheath 3A is inserted into the spatial part 7C of the switching pressure member 7, and the switching pressure member 7 is fitted on the outer periphery of the sheath 3A, as illustrated in FIG. 25. Then, the widthwise central portion of the ring-shaped pressurizing part 7A of the switching pressure member 7 is pressurized as shown by outside arrows, to cause the pressurizing protrusions 7B to pressurize the pressurizing parts 3D as shown by inside arrows. Consequently, the first and second conductor films 4 and 5 are pressed to come into contact with each other and conduct electricity. FIG. 26 illustrates the condition that the switching pressure member 7 is pressurized with fingers F1 and F2 to make the cable conductive. When pressurization with fingers is canceled, respective members revert to their original states due to the force of restitution ascribable to the materials of the members. In addition, the first and second conductor films 4 and 5 separate from each other to become non-conductive. Note that the switching pressure member 7 can be pinched with fingers to move the member in an optional direction somewhat forcibly against the frictional force between the inner surfaces of the switching pressure member 7 and the external surfaces of the sheath 3A in contact with the switching pressure member. Releasing the fingers causes the switching pressure member 7 to stop at the current position thereof, so that the member may not become displaced due to, for example, vibration caused when a user walks. These advantages can be realized by appropriately setting the internal shape of the switching pressure member 7 and the external shape of the switch-containing cable 1A, and selecting the materials of respective members to adjust coefficients of friction among the respective members.

Figure 27:
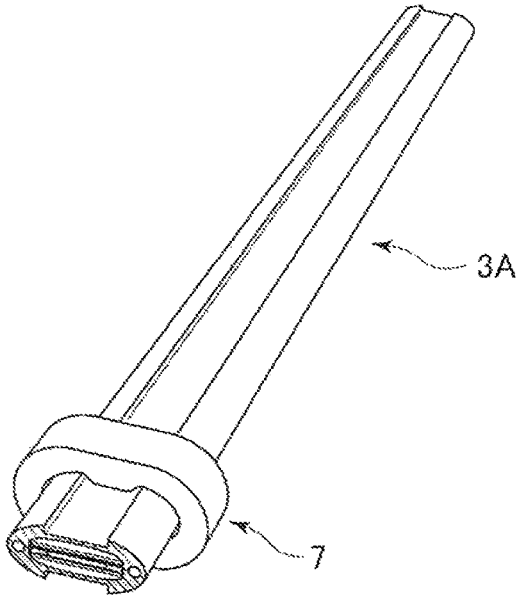
FIG. 27 is a perspective view of the fourth embodiment.
Figure 28:
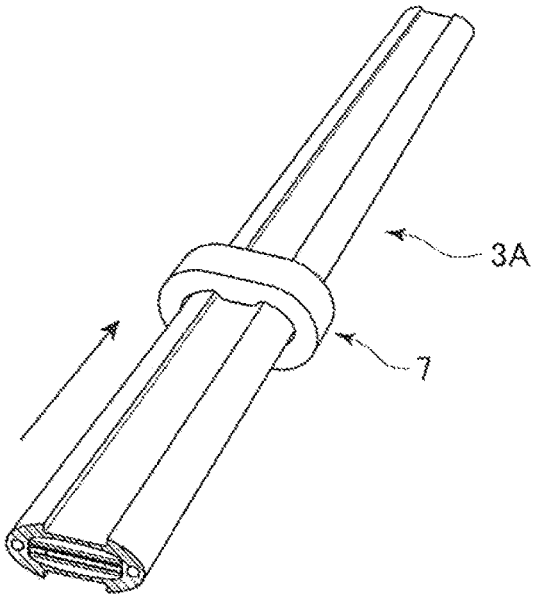
FIG. 28 is an explanatory view in which the switching pressure member of the fourth embodiment is moved.
Figure 29:
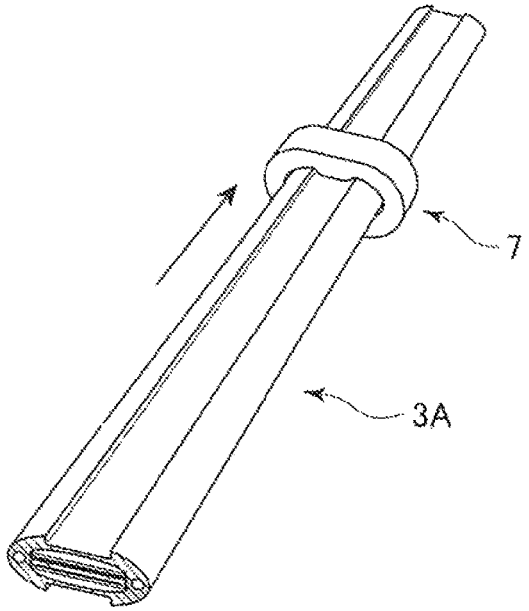
FIG. 29 is an explanatory view in which the switching pressure member of the fourth embodiment is moved further.

FIGS. 27 to 29 illustrate the condition that the switching pressure member 7 is moved to an optional position.

Figure 30:
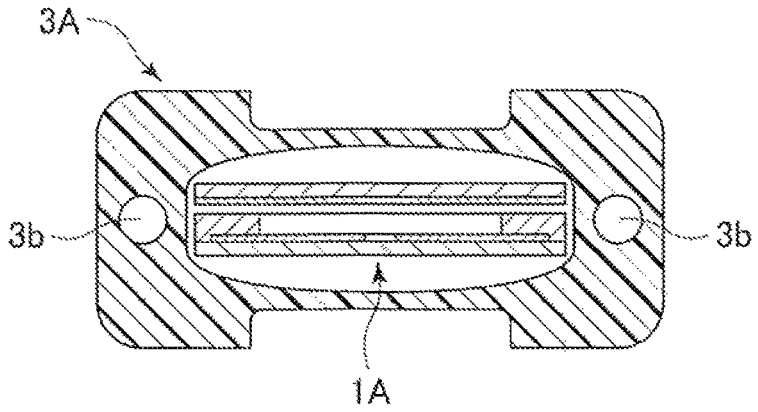
FIG. 30 is another example of the shape of the sheath in the fourth embodiment.
Figure 31:
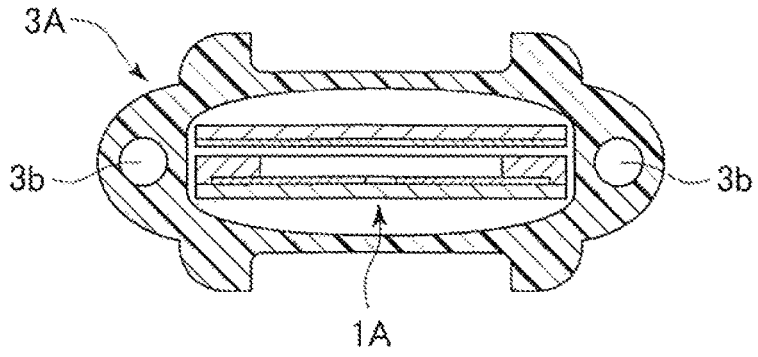
FIG. 31 is yet another example of the shape of the sheath.

FIGS. 30 and 31 illustrate examples of other shapes of the sheath 3A different from the shape illustrated in FIG. 22.

Note that in the present invention, lead wires (not illustrated) can be wired through the lead wire insertion holes 3*b* formed in the sheaths 3 and 3A, so that the cables may be used as signal transfer cables with built-in switch functions. When this switch-containing cable 1 is used as, for example, a cable for headphones, lead wires for audio signals can be threaded through the holes. If a rechargeable battery is housed in a headphone body, lead wires for electrical charge, for example, can be threaded through the holes. Note that these lead wires may be threaded through later, or may be previously threaded through at the time of fabricating a sheath before the belt-like conductor film 2 is inserted.

The cable switch of the present invention does not turn on at the time of bending. Consequently, the cable switch can be installed on a curved surface to use the switch also as a touch sensor.

DESCRIPTION OF SYMBOLS

1, 1A: Switch-containing cable
2, 2A: Belt-like conductor film
3, 3A: Sheath
3*a*: Hollow cavity
3*b*: Lead wire insertion hole
3B: Swelled part
3C: Groove
3D: Pressurizing part
4: First conductor film

4*a*: First belt-like base material
4*b*: First conductor
4*c*: Lead
4*d*: Connecting electrode
5: Second conductor film
5*a*: Second belt-like base material
5*b*: Second conductor
5*c*: Lead
5*d*: Connecting electrode
6, 6A: Insulating spacer
6*a*: Window
6*b*: Insulator
6*c*: Sash bar-like insulator
7: Switching pressure member
7A: Ring-shaped pressurizing part
7B: Pressurizing protrusion

What is claimed is:

1. A switch-containing cable for earphones comprising:

a belt-like first conductor film including a first belt-like base material on an inner surface of which a first conductor is disposed;

a belt-like second conductor film disposed oppositely to the first conductor film through a gap and including a second belt-like base material on an inner surface of which a second conductor is likewise disposed;

an insulating spacer arranged between the second conductor film and the first conductor film to maintain a gap therebetween; and a belt-like sheath having a hollow cavity extending in a length direction to a greater extent than either width or height directions, the belt-like first and second conductor films and the insulating spacer being held in the hollow cavity extending in the length direction, and the belt-like first and second conductor films function as a switch member in the hollow cavity when pressed together in the height direction;

wherein lead wires for carrying audio signals are provided in lead wire insertion holes formed in widthwise two ends of the sheath extending in the length direction in parallel with the hollow cavity;

wherein the belt-like first conductor film is not fixed to either the insulating spacer or the belt-like second conductor film in the hollow cavity where the belt-like first and second conductor films function as the switch member; and wherein the belt-like first conductor film is movably overlaid on the insulating spacer, and the hollow cavity of the sheath includes adequate margins, such that when the sheath is bended in the length direction, relative displacement of at least the belt-like first conductor film over the belt-like second conductor film is allowed within the hollow cavity in the length direction, avoiding inadvertent function of the switch member when the switch-containing cable for earphones is bended.

2. The switch-containing cable according to claim 1, wherein a gap between an inner wall of the hollow cavity of the sheath and an outer surface of one of the belt-like first and second conductor films is formed so as to be larger in a vicinity of a widthwise center of the belt-like conductor film than at widthwise ends of the belt-like conductor film.

3. The switch-containing cable according to claim 2, wherein swelled parts are formed in widthwise two ends of the sheath, a pair of grooves are formed between the swelled parts, a movable horizontally-long ring-shaped switching pressure member is disposed on an outer periphery of the sheath, and pressurizing protrusions for pressurizing the bottoms of the grooves by an external force are disposed in the switching pressure member.

4. The switch-containing cable according to claim 1, wherein swelled parts are formed in widthwise two ends of the sheath, a pair of grooves are formed between the swelled parts, a movable horizontally-long ring-shaped switching pressure member is disposed on an outer periphery of the sheath, and pressurizing protrusions for pressurizing bottoms of the grooves by an external force are disposed in the switching pressure member.

* * * * *